US007537176B2

(12) United States Patent
Shen

(10) Patent No.: US 7,537,176 B2
(45) Date of Patent: May 26, 2009

(54) SHREDDER WITH SHREDS CONTAINMENT AND SAFETY MECHANISMS

(76) Inventor: Jinlong Shen, 16 North Linyu Road, Zhenhai, Ningbo, Zhejiang Province (CN) 315207

( * ) Notice: Subject to any disclaimer, the term of this patent is extended or adjusted under 35 U.S.C. 154(b) by 136 days.

(21) Appl. No.: 11/772,680

(22) Filed: Jul. 2, 2007

(65) Prior Publication Data

US 2008/0277511 A1 Nov. 13, 2008

(30) Foreign Application Priority Data

May 11, 2007 (CN) ..... 2007 1 0068547
Jun. 20, 2007 (CN) ..... 2007 2 0110990
Jun. 27, 2007 (CN) ..... 2007 2 0111202

(51) Int. Cl.
*B02C 18/16* (2006.01)

(52) U.S. Cl. ..... 241/37.5; 241/100; 241/236; 241/285.3

(58) Field of Classification Search ..... 241/37.5, 241/100, 236, 285.3
See application file for complete search history.

(56) References Cited

U.S. PATENT DOCUMENTS 4,637,560 A * 1/1987 Goldhammer ..... 241/100
2007/0023552 A1* 2/2007 Easton et al. ..... 241/100
2007/0145170 A1* 6/2007 Easton et al. ..... 241/100

* cited by examiner

*Primary Examiner*—Mark Rosenbaum
(74) *Attorney, Agent, or Firm*—Arnold & Porter LLP

(57) ABSTRACT

In accordance with a preferred embodiment of the present invention, a shredder with shreds containment and safety mechanisms is provided that includes a shredder core and a container. The shredder core comprises a shredder head. The shredder head and the container have shreds containment and safety mechanisms that comprise at least one set of a rocker arm, a spring seat, a cover plate for the paper exit, and a knockout pin. The rocker arm, the spring seat and the cover plate are assembled together by a torque spring and installed at the bottom of the shredder head, with one end of the torque spring connected to the spring seat, and the other end of the torque spring connected to the bottom of the shredder head. The spring seat is securely installed at an end of a fixing piece, which is in turn securely attached to the bottom of the shredder head. The rocker arm is installed at the outward side of the spring seat and connected to the cover plate. The knockout pin is installed on the container and contacts and engages the rocker arm.

6 Claims, 9 Drawing Sheets

SHREDDER WITH SHREDS CONTAINMENT AND SAFETY MECHANISMS

CROSS-REFERENCE TO RELATED APPLICATION

The present application claims the benefit of Chinese Patent Application No. 200710068547.5, filed May 11, 2007, the contents of which are incorporated herein by reference in their entirety. The present application also claims the benefit of Chinese Patent Application No. 200720110990.X, filed Jun. 20, 2007, and Chinese Patent Application No. 200720111202.9, filed Jun. 27, 2007.

FIELD OF INVENTION

The present invention relates to shredders with shreds containment and safety mechanisms.

BACKGROUND OF INVENTION

Currently there are two common types of shredders. The first type of shredder, a top-lifting shredder, has a shredder head mounted atop a container. When the shredder is in operation, the shreds drop from the shredder head into the container. When the container is substantially full of shreds, the shredder head is removed from the container, and the shreds in the container are discarded. Another common type of shredder is a drawer-type shredder which has the shredder head mounted atop an outer bin. The outer bin includes a left-side wall, a right-side wall and a rear wall and a bottom. A front of the outer bin is an opening that defines an open space for receiving a drawer-type container for shreds. When the container is full of shreds from the operation of shredder, it is removed from the outer bin and the shreds are discarded. A problem facing these common types of shredders is that shreds may remain in the shredder head and also drop to the crevices around the container. When the container is removed to discard the shreds, shreds remaining in the shredder head and gathered in the crevices around the container would drop to the ground, which would require cleaning up. Furthermore, even though covering plates may have been installed to cover the paper exit, which is an opening at the bottom of the shredder head that exposes the cutter elements of the shredder head, when the shredder head is removed from the container or when the container is removed from the outer bin to discard the shreds, the cutter elements in the shredder head would be easily exposed and may cause injury to fingers of the operator.

SUMMARY OF THE INVENTION

In accordance with a preferred embodiment of the present invention, a shredder with shreds containment and safety mechanisms is provided that includes a shredder core and a container. The shredder core comprises a shredder head. The shredder head and the container have shreds containment and safety mechanisms that comprise at least one set of a rocker arm, a spring seat, a cover plate for the paper exit, and a knockout pin. The rocker arm, the spring seat and the cover plate are assembled together by a torque spring and installed at the bottom of the shredder head, with one end of the torque spring connected to the spring seat, and the other end of the torque spring connected to the bottom of the shredder head. The spring seat is securely installed at an end of a fixing piece, which is in turn securely attached to the bottom of the shredder head. The rocker arm is installed at the outward side of the spring seat and connected to the cover plate. The knockout pin is installed on the container and contacts and engages the rocker arm.

Other objects, features, and advantages of the present invention will become apparent from the following detailed description, the accompanying drawings, and the claims.

DETAILED DESCRIPTION OF THE INVENTION

Figure 1:
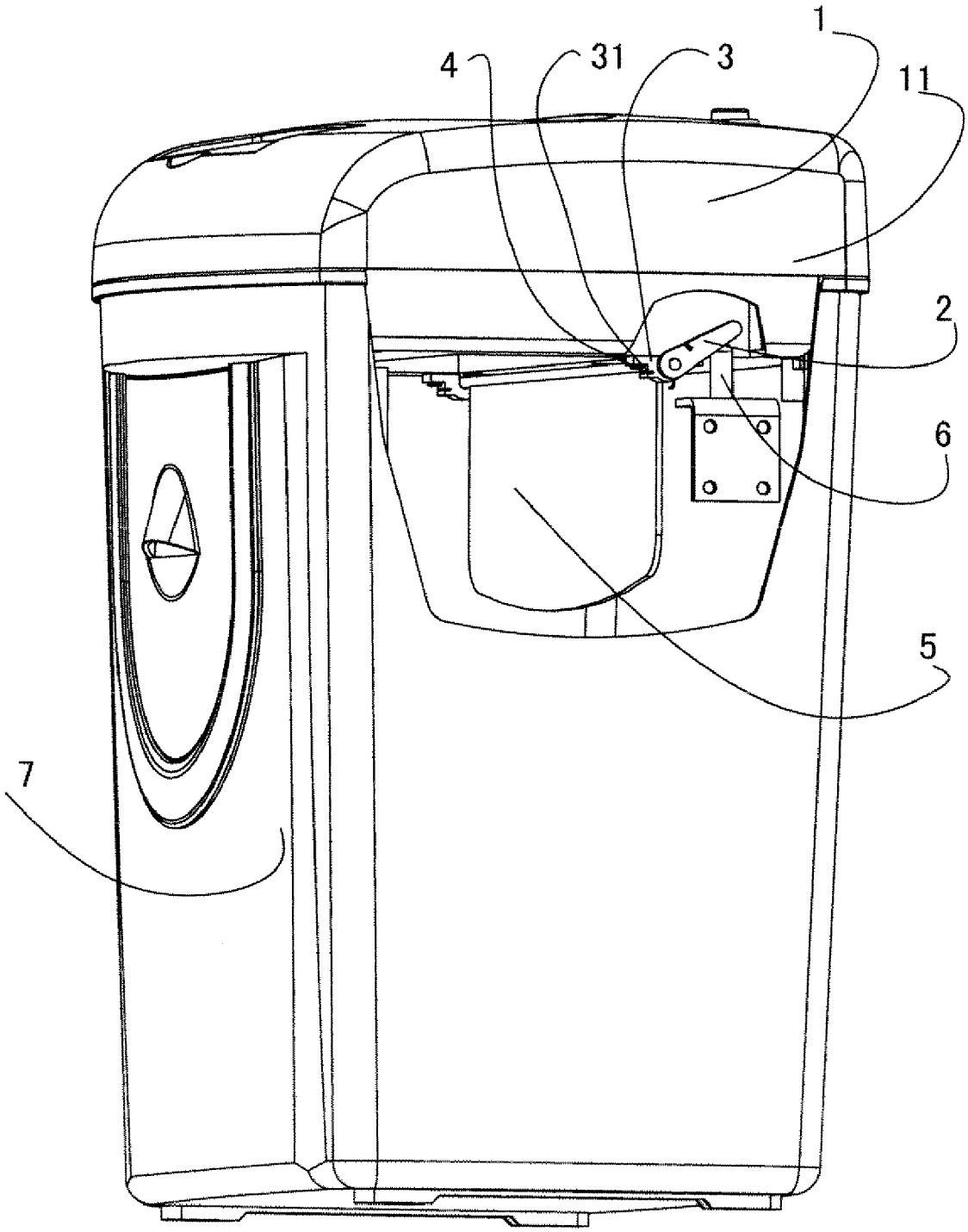
FIG. 1 is a perspective/cutaway view of a shredder constructed in accordance with an embodiment of the present invention.

The present invention discloses a shredder with shreds containment and safety mechanisms comprising: a shredder core and a container. The shredder core comprises a shredder head. The shredder head and the container have shreds containment and safety mechanisms that comprise at least one set of a rocker arm, a spring seat, a cover plate for the paper exit, and a knockout pin. The rocker arm, the spring seat and the cover plate is assembled together by a torque spring and installed at the bottom of the shredder head, with one end of the torque spring connected to the spring seat, and the other end of the torque spring connected to the bottom of the shredder head. The spring seat is securely installed at an end of a fixing piece, which is in turn securely attached to the bottom of the shredder head. The rocker arm is installed at the outward side of the spring seat and connected to the cover plate. The knockout pin is installed on the container and contacts and engages the rocker arm.

In one embodiment of the present invention, the shredder with shreds containment and safety mechanisms is a top-lifting type of shredder, wherein the shredder head is mounted atop the container, and the knockout pin is installed on the inner wall of the container.

In one embodiment of the present invention, the shredder with shreds containment and safety mechanisms is a drawer-type shredder where the shredder core comprises a shredder head mounted atop an outer bin. The container is fully receivable into the outer bin. The knockout pin is installed on the inner wall of the container and when the container is fully received into the outer bin, the knockout pin engages the rocker arm and the cover plate is rotated to expose the paper exit.

In one embodiment of the present invention, the shredder head and the container have shreds containment and safety mechanisms that comprise two rocker arms, two spring seats, two cover plates for the paper exit, and two knockout pins.

When the shredder core is removed from the container, either the shredder core being lifted up from the container in a top-lifting shredder or the container being removed from the outer bin in a drawer-type shredder, the cover plate or cover plates automatically close to cover the paper exit through the operation of the torque spring; and the shreds remaining in the shredder head are contained therein and cannot drop to the ground. Furthermore, with the cover plate covering the paper exit and the cutter elements in the shredder head, chances for injuries to fingers of an operator due to inadvertent contact with the cutter elements are minimized or eliminated.

Embodiments of the present invention are described with reference to FIGS. 1-9.

FIGS. 1-9 illustrate a shredder with shreds containment and safety mechanisms of the present invention comprising: a shredder core 1 and a container 7. The shredder core 1 comprises a shredder head 11. The shredder head 11 and the container 7 have shreds containment and safety mechanisms that comprise at least one set of a rocker arm 2, a spring seat 3, a cover plate 5 for the paper exit, and a knockout pin 6. The rocker arm 2, the spring seat 3 and the cover plate 5 are assembled together by a torque spring 31 and installed at the bottom of the shredder head 11, with one end of the torque spring 31 connected to the spring seat 3, and the other end of the torque spring connected to the bottom of the shredder head 11. The spring seat 3 is securely installed at an end of a fixing piece 4, which is in turn securely attached to the bottom of the shredder head 11. The rocker arm 2 is installed at the outward side of the spring seat 3 and connected to the cover plate 5. The knockout pin 6 is installed on the container 7 and contacts and engages the rocker arm 2. Upon engagement of the knockout pin 6 with the rocker arm 2, the cover plate 5 is rotated to expose the paper exit.

Figure 2:
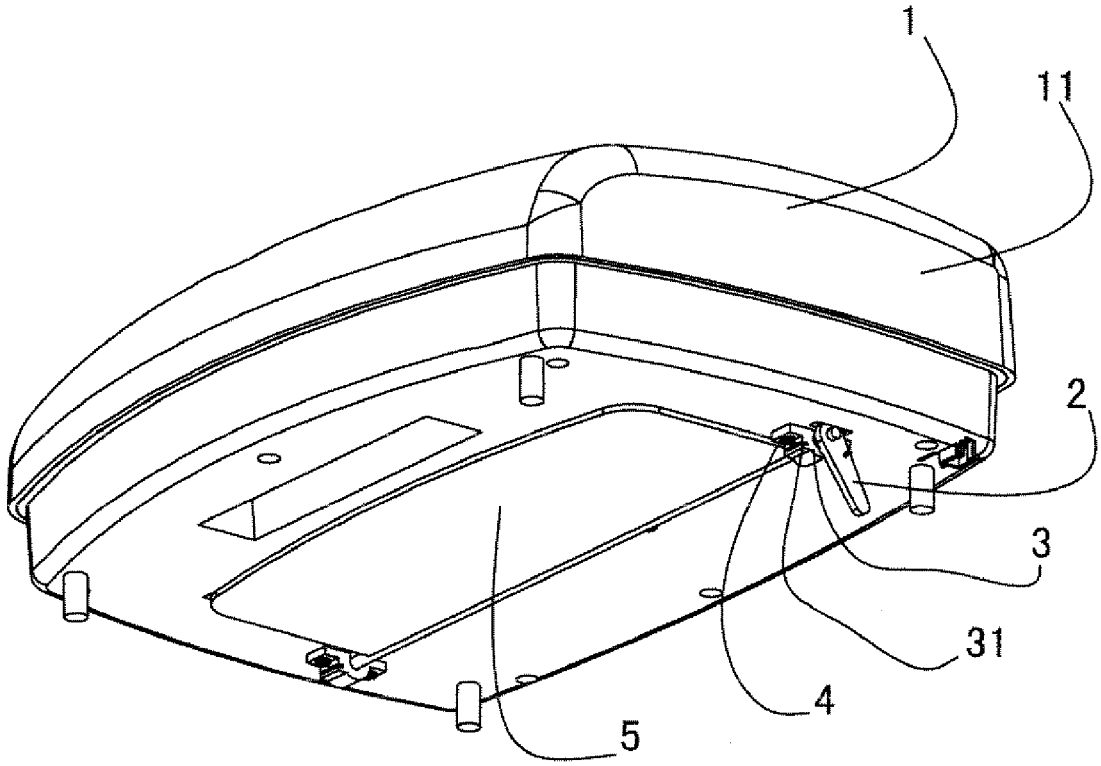
FIG. 2 is a perspective view of the shredder head in FIG. 1 where the shredder head is removed from the container and the cover plate covers the paper exit.

FIGS. 1-2 illustrate one embodiment of the present invention, the shredder with shreds containment and safety mechanisms is a top-lifting type of shredder, wherein the shredder head 11 is mounted atop the container 7, and the knockout pin 6 is installed on the inner wall of the container 7. The knockout pin 6 contacts and engages the rocker arm 2. Upon engagement of the knockout pin 6 with the rocker arm 2, and the rocker arm 2 drives the spring seat 3 and the fixed piece 4 to rotate the cover plate 5 to expose the paper exit. FIG. 1 illustrates that the cover plate 5 rotates away and exposes the paper exit when the shredder head 11 mounts atop the container 7, to ensure that proper operation of the shredder.

When the shredder head 11 is removed from the container 7, the knockout pin 6 which is installed on the container 7 disengages the rocker arm 2, and the torque spring 31 drives the spring seat 3 and the fixed piece 4 to automatically rotates the cover plate 5 to cover the paper exit of the shredder head 11. Shreds remaining in the shredder head 11 are contained behind the cover plate 5. FIG. 2 illustrates that the cover plate 5 covers the paper exit when the shredder head 11 is removed from the container 7 and the shreds are prevented from falling onto the ground and eliminates the need for cleaning up. Furthermore, with the cover plate 5 covering the paper exit and the cutter elements in the shredder head 11, chances for injuries to fingers of an operator due to inadvertent contact with the cutter elements are minimized or eliminated.

Figure 3:
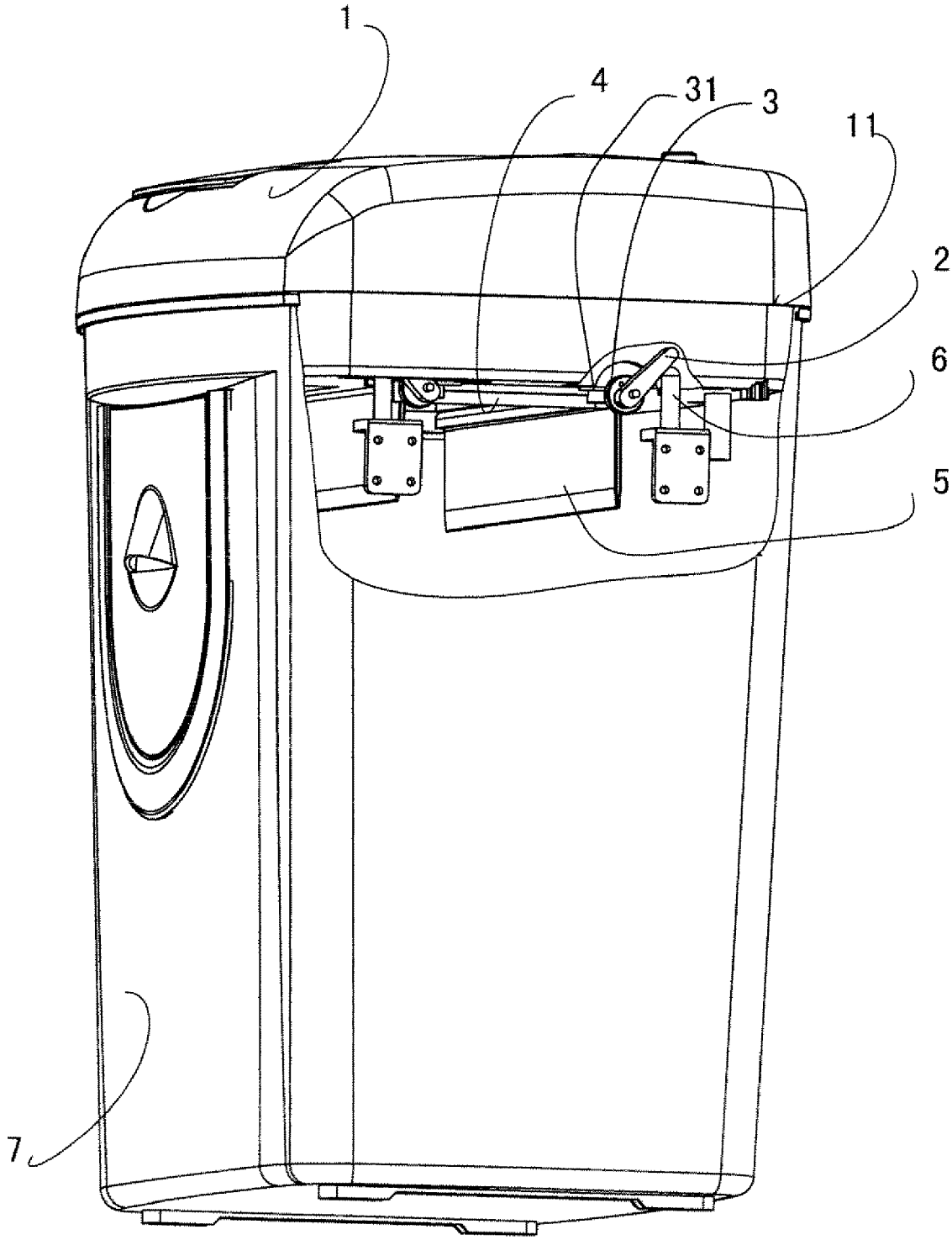
FIG. 3 is a perspective/cutaway view of a variation of a shredder constructed in accordance with an embodiment of the present invention, wherein the shreds containment and safety mechanisms comprise two rocker arms, two spring seats, two cover plates for the paper exit, and two knockout pins.
Figure 4:
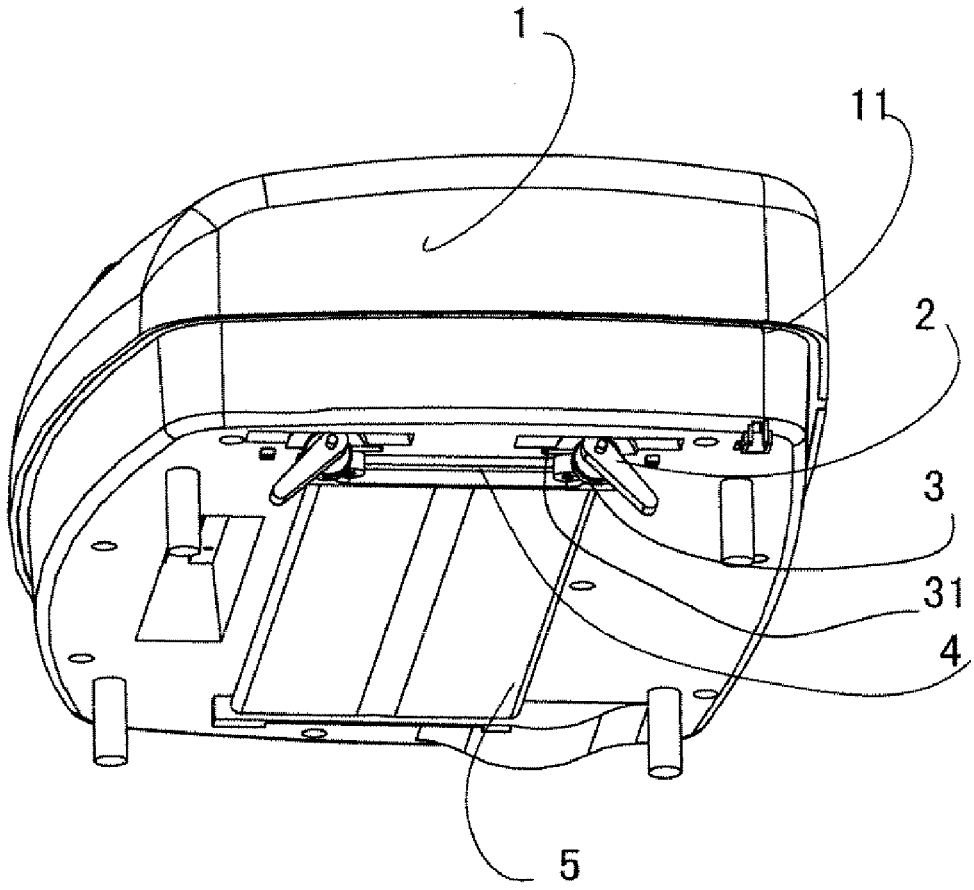
FIG. 4 is a perspective view of the shredder head in FIG. 3 where the shredder head is removed from the container and the cover plates cover the paper exit.

FIGS. 3 and 4 illustrate a variation of a shredder constructed in accordance with the above embodiment of the present invention, wherein the shreds containment and safety mechanisms comprise two rocker arms 2, two spring seats 3, two cover plates 5 for the paper exit, and two knockout pins 6. This variation operates in substantially the same manner as the above embodiment of the present invention.

Figure 5:
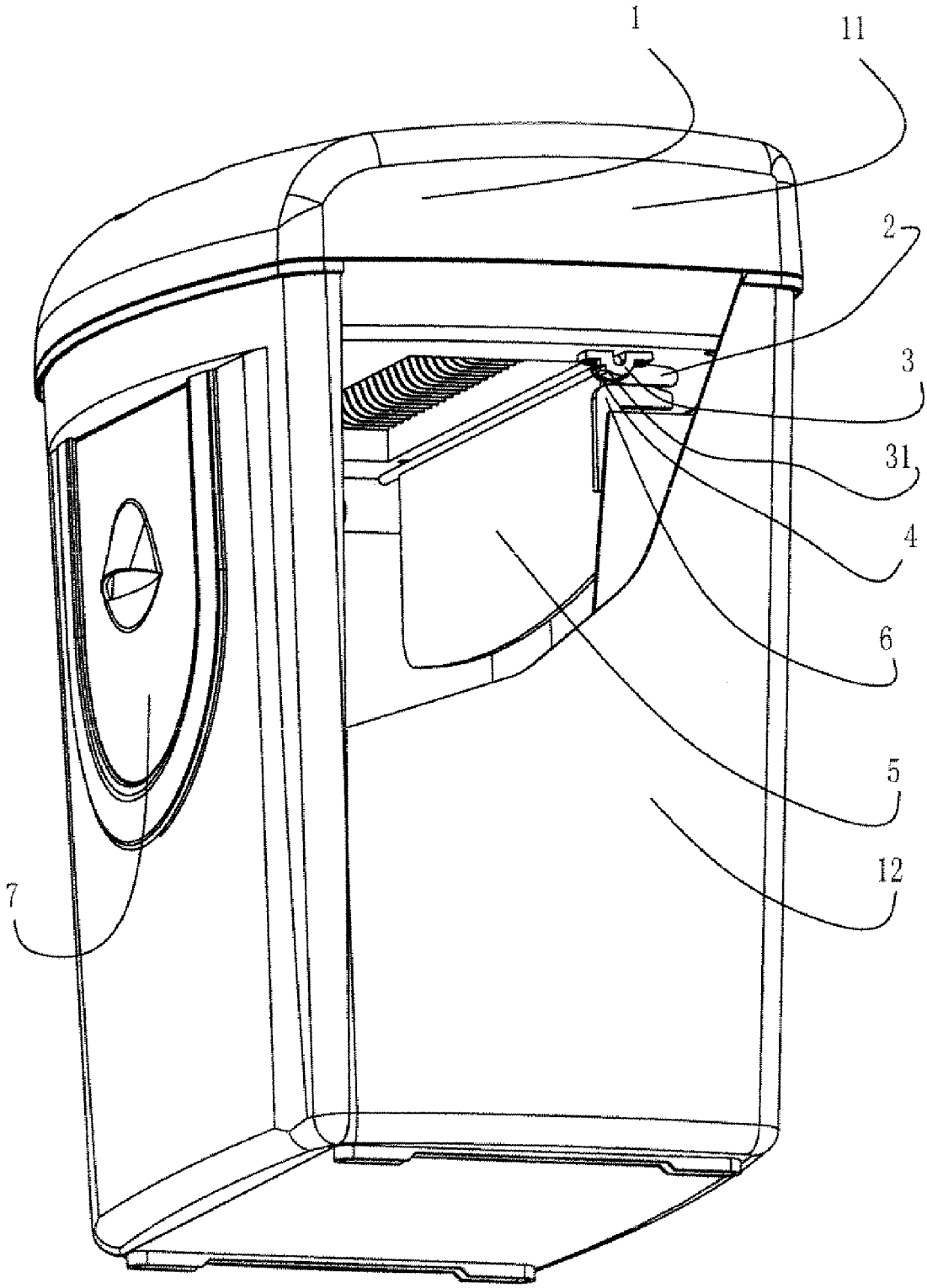
FIG. 5 is a perspective/cutaway view of a shredder constructed in accordance with another embodiment of the present invention.
Figure 6:
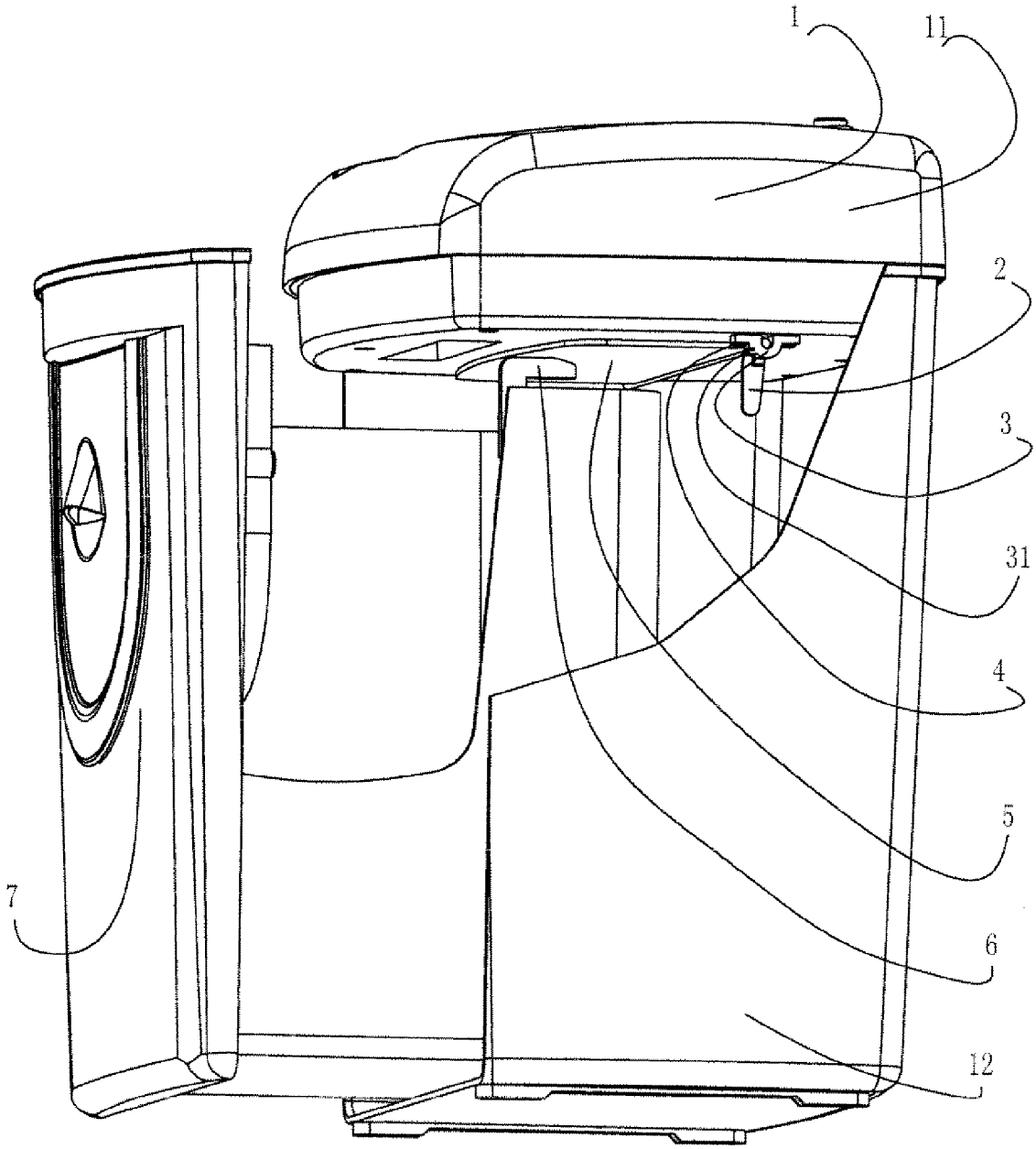
FIG. 6 is a perspective view of the shredder head in FIG. 5 where the container is partially removed from the outer bin and the cover plate covers the paper exit.
Figure 7:
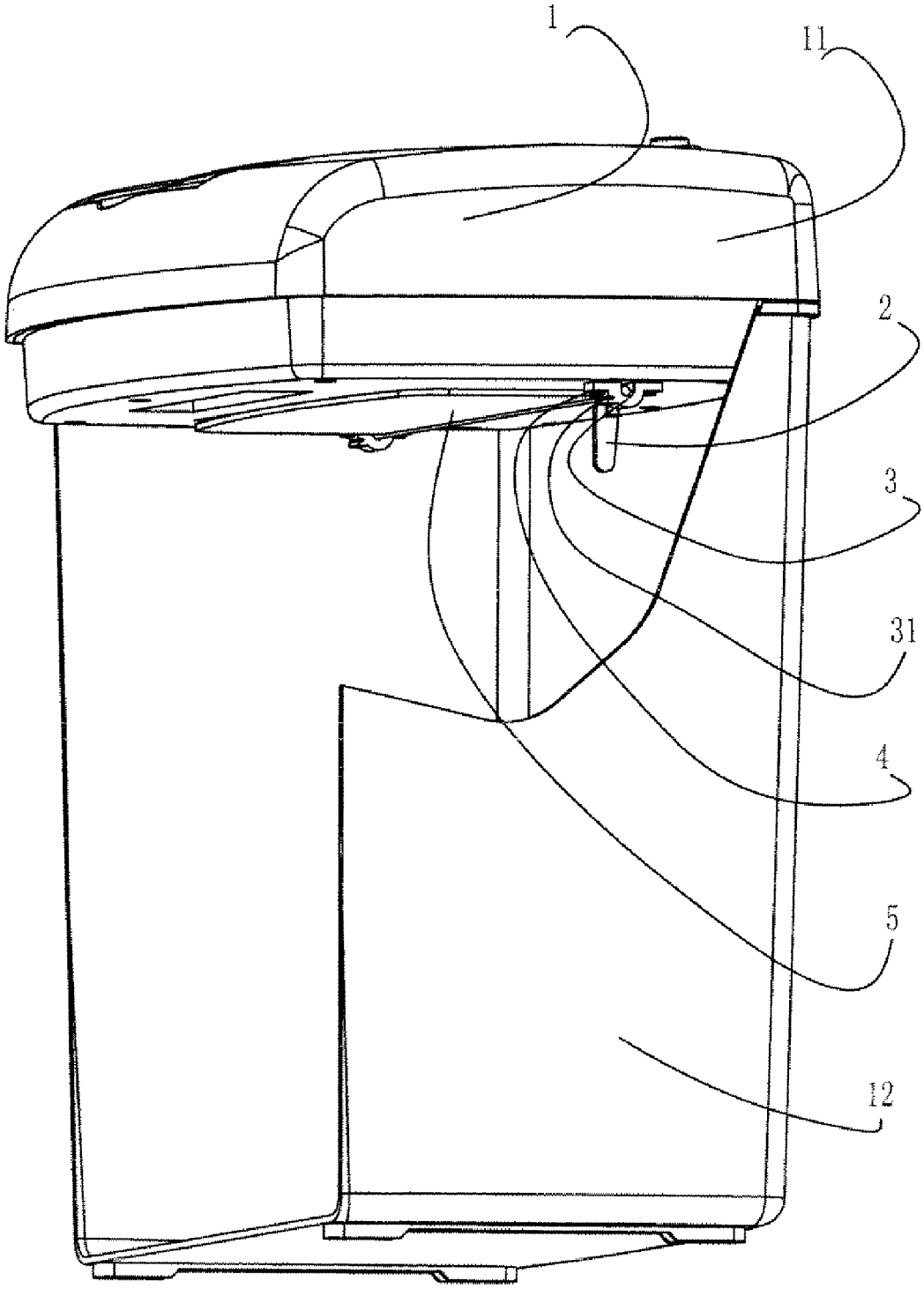
FIG. 7 is a perspective view of the shredder head in FIG. 5 where the container is completely removed from the outer bin and the cover plate covers the paper exit.

FIGS. 5, 6 and 7 illustrate a second embodiment of the present invention, the shredder with shreds containment and safety mechanisms is a drawer-type shredder, wherein the shredder core 1 further comprises an outer bin 12 and the shredder head 11 is mounted atop the outer bin 12. The container 7 is a drawer-type container and is received into the outer bin 12. The knockout pin 6 is installed on the inner wall of the container 7.

FIG. 5 illustrates that the cover plate 5 rotates away and exposes the paper exit when the shredder head 11 mounts atop the outer bin 12 and the container 7 is fully received into the outer bin 12, to ensure that proper operation of the shredder. The cover plate 5 thus rotated blocks and contains the shreds and prevents the shreds from scattering into the crevices between the container 7 and the outer bin 12.

When the container 7 is gradually removed from the outer bin 12, the knockout pin 6 which is installed on the container 7 disengages the rocker arm 2, and the cover plate 5, driven by the torque spring 31, automatically rotates to cover the paper exit of the shredder head 11. Shreds remaining in the shredder head 11 are contained behind the cover plate 5. FIG. 7 illustrates that the cover plate 5 covers the paper exit when the container 7 is removed from the outer bin 12 and the shredder head 11 mounted thereupon. The shreds are prevented from falling into the outer bin 12 and eliminates the need for cleaning up. Furthermore, with the cover plate 5 covering the paper exit and the cutter elements in the shredder head 11, chances for injuries to fingers of an operator due to inadvertent contact with the cutter elements are minimized or eliminated.

Figure 8:
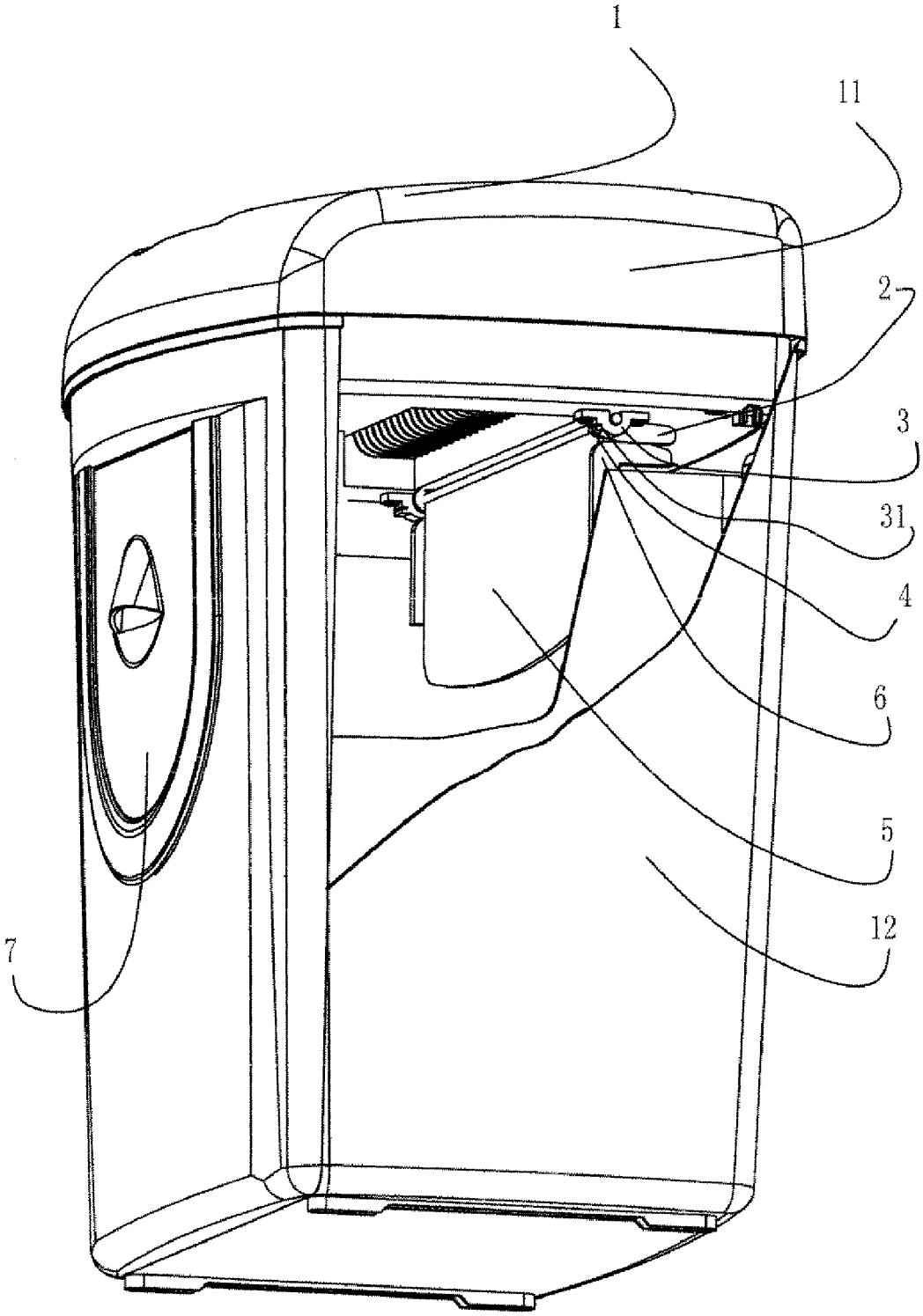
FIG. 8 is a perspective/cutaway view of a variation of a shredder constructed in accordance with another embodiment of the present invention, wherein the shreds containment and safety mechanisms comprise two rocker arms, two spring seats, one cover plate for the paper exit, and two knockout pins.
Figure 9:
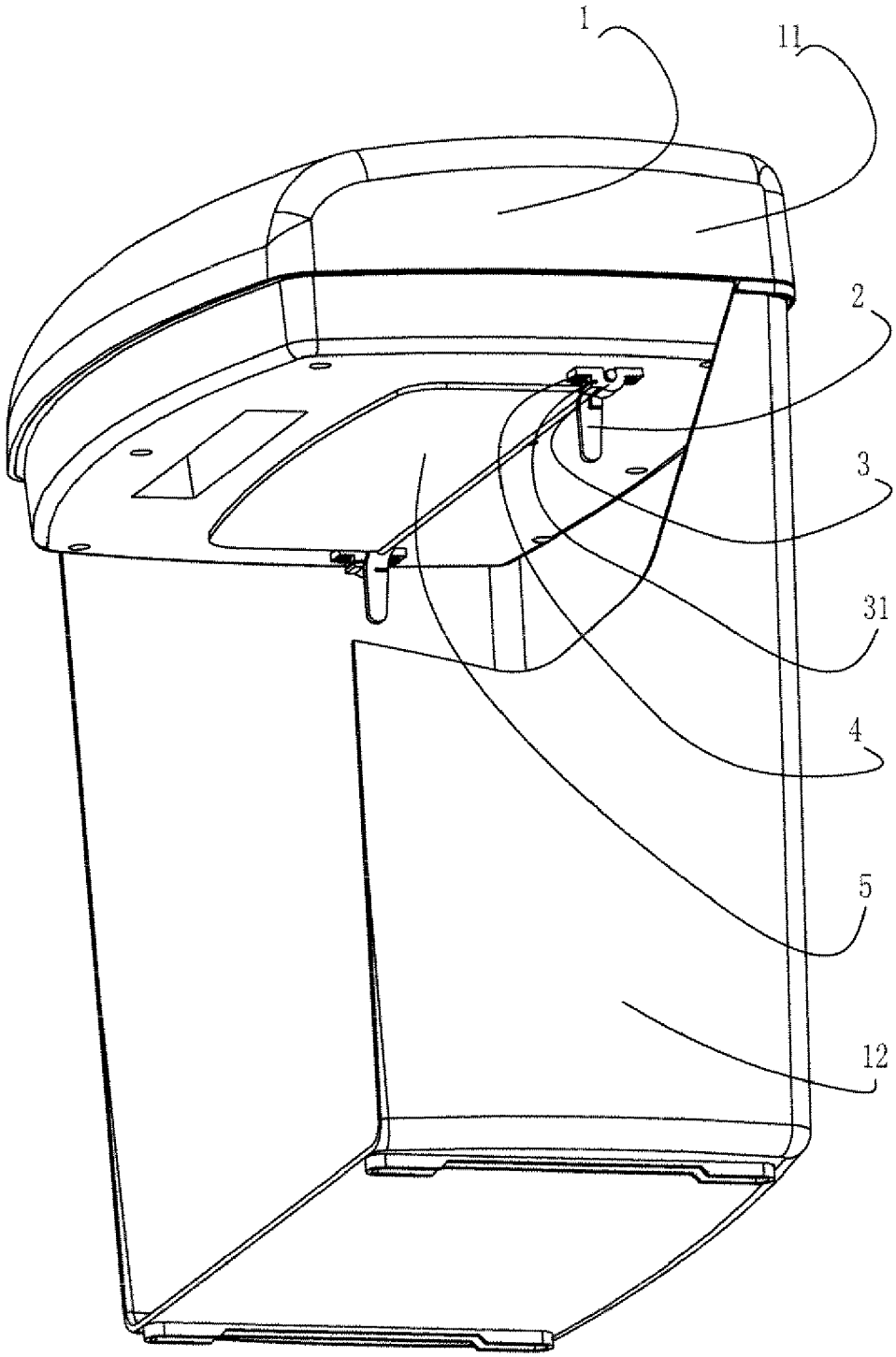
FIG. 9 is a perspective view of the shredder head in FIG. 8 where the container is completely removed from the outer bin and the cover plate covers the paper exit.

FIGS. 8 and 9 illustrate a variation of a shredder constructed in accordance with the above second embodiment of the present invention, wherein the shreds containment and safety mechanisms comprise two rocker arms 2, two spring seats 3, one cover plate 5 for the paper exit, and two knockout pins 6. This variation operates in substantially the same manner as the above embodiment of the present invention.

The foregoing illustrated embodiments have been provided to illustrate the structural and functional principles of the present invention and is not intended to be limiting. To the contrary, the present invention is intended to encompass all modifications, alternations, and substitutions within the spirit and scope of the claims.

The invention claimed is:

1. A shredder comprising:

a shredder core having a shredder head; and a container;

wherein the shredder head and the container have shreds containment and safety mechanisms that comprise at least one set of a rocker arm, a spring seat, a cover plate for the paper exit, and a knockout pin;

wherein the rocker arm, the spring seat and the cover plate are assembled together by a torque spring and installed at the bottom of the shredder head, with one end of the torque spring connected to the spring seat, and the other end of the torque spring connected to the bottom of the shredder head;

wherein the spring seat is securely installed at an end of a fixing piece, which is in turn securely attached to the bottom of the shredder head;

wherein the rocker arm is installed at the outward side of the spring seat and connected to the cover plate; and wherein the knockout pin is installed on the container and contacts and engages the rocker arm.

2. The shredder according to claim 1, wherein the shredder head and the container have shreds containment and safety mechanisms that comprise two rocker arms, two spring seats, two cover plates for the paper exit, and two knockout pins.

3. The shredder according to claim 1, wherein the shredder head is mounted atop the container, and the knockout pin is installed on the inner wall of the container.

4. The shredder according to claim 3, wherein the shredder head and the container have shreds containment and safety mechanisms that comprise two rocker arms, two spring seats, two cover plates for the paper exit, and two knockout pins.

5. The shredder according to claim 1, wherein the shredder core comprises a shredder head mounted atop an outer bin, and the knockout pin is installed on the internal wall of the container that is fully receivable into the outer bin.

6. The shredder according to claim 5, wherein the shredder head and the container have shreds containment and safety mechanisms that comprise two rocker arms, two spring seats, one cover plate for the paper exit, and two knockout pins.

* * * * *